US009075424B2

(12) United States Patent
Guhados et al.

(10) Patent No.: US 9,075,424 B2
(45) Date of Patent: Jul. 7, 2015

(54) COMPENSATION SCHEME TO IMPROVE THE STABILITY OF THE OPERATIONAL AMPLIFIERS

(71) Applicant: SanDisk Technologies Inc., Plano, TX (US)

(72) Inventors: Shankar Guhados, Fremont, CA (US); Feng Pan, Fremont, CA (US)

(73) Assignee: SanDisk Technologies Inc., Plano, TX (US)

( * ) Notice: Subject to any disclaimer, the term of this patent is extended or adjusted under 35 U.S.C. 154(b) by 305 days.

(21) Appl. No.: 13/787,419

(22) Filed: Mar. 6, 2013

(65) Prior Publication Data

US 2014/0253057 A1 Sep. 11, 2014

(51) Int. Cl.
*G05F 3/24* (2006.01)
*G05F 1/625* (2006.01)

(52) U.S. Cl.
CPC ..... *G05F 1/625* (2013.01)

(58) Field of Classification Search
CPC ..... G05F 1/56; G05F 1/625; G05F 1/575; G05F 1/465; G05F 3/30; G05F 3/24; G05F 3/262; G05F 3/265; H02M 3/1584; H02M 3/1588
USPC ..... 323/265, 268, 271, 273, 312, 316; 327/538, 540, 541, 543
See application file for complete search history.

(56) References Cited

U.S. PATENT DOCUMENTS 4,780,624 A * 10/1988 Nicollini et al. ..... 327/541
4,912,427 A * 3/1990 Rybicki ..... 330/257
4,928,056 A * 5/1990 Pease ..... 323/314
5,387,880 A * 2/1995 Kobayashi ..... 330/296
5,602,789 A 2/1997 Endoh et al.
5,642,322 A 6/1997 Yoneda
6,157,558 A 12/2000 Wong
6,166,938 A 12/2000 Wong
6,317,349 B1 11/2001 Wong
6,433,621 B1 * 8/2002 Smith et al. ..... 327/538
6,970,988 B1 11/2005 Chung
6,975,838 B1 * 12/2005 Rofougaran et al. ..... 455/20
7,005,350 B2 2/2006 Walker et al.
7,019,584 B2 * 3/2006 Bartel et al. ..... 327/539

(Continued)

FOREIGN PATENT DOCUMENTS

EP 1720168 11/2006
EP 1988474 11/2008
WO WO 2011/007304 1/2011

OTHER PUBLICATIONS

Lu et al., Bloomstore: Bloom Filter Based Memory-Efficient Key-Value Store for Indexing of Data Deduplication on Flash, Mass Storage Systems and Technologies, Apr. 16, 2012, IEEE 28th Symposium, pp. 1-11.

(Continued)

*Primary Examiner* — Adolf Berhane

(74) *Attorney, Agent, or Firm* — Davis Wright Tremaine LLP

(57) ABSTRACT

A right-half plane (RHP) zero (RHZ) compensation scheme to improve the stability of the operational amplifier. A resistance $R_Z$ is implemented by a transistor. This transistor tracks process variations of the transistor drive by the op-amp to achieve better stability without requiring a bandwidth reduction. As a current source is not available to bias this transistor, a local bias circuit is used to provide this.

8 Claims, 2 Drawing Sheets

(56) References Cited

U.S. PATENT DOCUMENTS

| | | | | |
|---|---|---|---|---|
| 7,019,585 | B1 * | 3/2006 | Wilson et al. | 327/541 |
| 7,206,230 | B2 | 4/2007 | Li et al. | |
| 7,237,058 | B2 | 6/2007 | Srinivasan | |
| 7,292,476 | B2 | 11/2007 | Goda et al. | |
| 7,358,807 | B2 * | 4/2008 | Scuderi et al. | 330/140 |
| 7,400,532 | B2 | 7/2008 | Aritome | |
| 7,403,421 | B2 | 7/2008 | Mokhlesi et al. | |
| 7,412,561 | B2 | 8/2008 | Argyres et al. | |
| 7,450,422 | B2 | 11/2008 | Roohparvar | |
| 7,489,546 | B2 | 2/2009 | Roohparvar | |
| 7,505,321 | B2 | 3/2009 | Scheuerlein et al. | |
| 7,515,000 | B1 * | 4/2009 | Jin et al. | 330/279 |
| 7,560,987 | B1 * | 7/2009 | Cetin et al. | 330/258 |
| 7,586,380 | B1 * | 9/2009 | Natarajan et al. | 331/57 |
| 7,746,700 | B2 | 6/2010 | Roohparver | |
| 7,750,837 | B2 * | 7/2010 | Wang et al. | 341/172 |
| 8,102,705 | B2 | 1/2012 | Liu et al. | |
| 2001/0010057 | A1 | 7/2001 | Yamada | |
| 2002/0171652 | A1 | 11/2002 | Perego | |
| 2003/0002366 | A1 | 1/2003 | Mizoguchi et al. | |
| 2003/0007408 | A1 | 1/2003 | Lien et al. | |
| 2003/0012063 | A1 | 1/2003 | Chien | |
| 2003/0018868 | A1 | 1/2003 | Chung | |
| 2003/0117851 | A1 | 6/2003 | Lee et al. | |
| 2003/0163509 | A1 | 8/2003 | McKean et al. | |
| 2004/0123020 | A1 | 6/2004 | Gonzalez et al. | |
| 2004/0124466 | A1 | 7/2004 | Walker et al. | |
| 2004/0125629 | A1 | 7/2004 | Scheuerlein et al. | |
| 2004/0137878 | A1 | 7/2004 | Oyama | |
| 2004/0240484 | A1 | 12/2004 | Argyres et al. | |
| 2005/0078514 | A1 | 4/2005 | Scheuerlein et al. | |
| 2005/0141387 | A1 | 6/2005 | Cernea et al. | |
| 2006/0034121 | A1 | 2/2006 | Khalid et al. | |
| 2006/0095699 | A1 | 5/2006 | Kobayashi et al. | |
| 2006/0206770 | A1 | 9/2006 | Chen et al. | |
| 2006/0261401 | A1 | 11/2006 | Bhattacharyya | |
| 2007/0047314 | A1 | 3/2007 | Goda et al. | |
| 2007/0058407 | A1 | 3/2007 | Dosaka et al. | |
| 2007/0140012 | A1 | 6/2007 | Roohparvar | |
| 2007/0189073 | A1 | 8/2007 | Aritome | |
| 2007/0236990 | A1 | 10/2007 | Aritome | |
| 2007/0263462 | A1 | 11/2007 | Roohparvar | |
| 2007/0291542 | A1 | 12/2007 | Aritome | |
| 2008/0005459 | A1 | 1/2008 | Norman | |
| 2008/0031044 | A1 | 2/2008 | Roohparvar | |
| 2008/0062763 | A1 | 3/2008 | Park et al. | |
| 2008/0158989 | A1 | 7/2008 | Wan et al. | |
| 2008/0239808 | A1 | 10/2008 | Lin | |
| 2008/0266957 | A1 | 10/2008 | Moogat et al. | |
| 2009/0097311 | A1 | 4/2009 | Roohparvar et al. | |
| 2009/0129151 | A1 | 5/2009 | Roohparvar | |
| 2009/0129177 | A1 | 5/2009 | Roohparvar | |
| 2009/0141566 | A1 | 6/2009 | Arsovski | |
| 2009/0190404 | A1 | 7/2009 | Roohparvar | |
| 2009/0254694 | A1 | 10/2009 | Ehrman et al. | |
| 2009/0273975 | A1 | 11/2009 | Sarin et al. | |
| 2009/0303767 | A1 | 12/2009 | Akerib et al. | |
| 2010/0329007 | A1 | 12/2010 | Chibvongodze | |
| 2011/0002169 | A1 | 1/2011 | Li et al. | |
| 2011/0051485 | A1 | 3/2011 | Chang et al. | |
| 2011/0096601 | A1 | 4/2011 | Gavens et al. | |
| 2011/0096607 | A1 | 4/2011 | Roohparvar | |
| 2011/0103145 | A1 | 5/2011 | Sarin et al. | |
| 2011/0103153 | A1 | 5/2011 | Katsumata et al. | |
| 2011/0134676 | A1 | 6/2011 | Breitwisch et al. | |
| 2012/0005419 | A1 | 1/2012 | Wu et al. | |
| 2012/0102298 | A1 | 4/2012 | Sengupta et al. | |
| 2012/0250424 | A1 | 10/2012 | Yoshihara et al. | |
| 2013/0028021 | A1 | 1/2013 | Sharon et al. | |
| 2013/0042055 | A1 | 2/2013 | Kinoshita et al. | |
| 2013/0086303 | A1 | 4/2013 | Ludwig et al. | |

OTHER PUBLICATIONS

Wei et al., "DBA: A Dynamic Bloom Filter Array for Scalable Membership Representation of Variable Large Data Sets," Jul. 25-27, 2011, IEEE 19$^{th}$ Annual International Symposium of Modeling, Analysis and Simulation of Computer and Telecommunication Systems (Mascots 2011), pp. 466-468.

Maeda et al., "Multi-Stacked 1G Cell-Layer Pipe-Shaped BiCS Flash Memory," 2009 Symposium on VLSI Circuits, pp. 22-23.

U.S. Appl. No. 13/463,422, entitled Column Redundancy Circuitry for Non-Volatile Memory, filed May 3, 2012, 50 pages.

U.S. Appl. No. 13/420,961 entitled Techniques for Accessing Column Selecting Shift Register with Skipped Entries in Non-Volatile Memories, filed Mar. 15, 2012, 52 pages.

U.S. Appl. No. 61/713,038, entitled "Use of High Endurance Non-Volatile Memory for Read Accleration," filed Oct. 12, 2012, 93 pages.

U.S. Appl. No. 13/794,398, entitled De-Duplication Techniques Using NAND Flash Based Content Addressable Memory, filed Mar. 11, 2013, 80 pages.

U.S. Appl. No. 13/794,428 entitled "De-Duplication System Using NAND Flash Based Content Addressable Memory," filed Mar. 11, 2013, 80 pages.

U.S. Appl. No. 13/756,076 entitled "On-Device Data Analytics Using NAND Flash Based Intelligent Memory," filed Jan. 31, 2013, 67 pages.

U.S. Appl. No. 13/827,609 entitled "Data Search Using Bloom Filters and NAND Based Content Addressable Memory," filed Mar. 14, 2013, 82 pages.

Black, Jr., et al., "A High Performance Low Power CMOS Channel Filter," IEEE Journal of Solid-State Circuits, vol. SC-15, No. 6, Dec. 1980, pp. 929-938.

* cited by examiner

COMPENSATION SCHEME TO IMPROVE THE STABILITY OF THE OPERATIONAL AMPLIFIERS

FIELD OF THE INVENTION

This invention pertains generally to the field of operational amplifiers and, more particularly, to improving the stability of circuits using operational amplifiers.

BACKGROUND

Operational amplifiers (op-amps) are key analog blocks used in various high accuracy and high performance applications, such as cell phones, digital cameras, and MP3 players, to name a few. Op-amps also find use in memory products, such as flash memory, where unlike other applications memory analog design uses op-amps in both high voltage and low voltage domains. An important design challenge in these applications is the stability of the amplifiers across process and temperature. A number of prior art circuits have looked to improve the stability of these amplifiers; however, there is still an on-going need for the improvement of such circuit elements.

SUMMARY OF THE INVENTION

According to a first set of general aspects, a voltage supply circuit includes an output transistor connected between a supply level and an output node of the voltage supply circuit and an operational amplifier having a first input connected to a reference level and a second input connected to receive feedback derived from the level on the output node of the voltage supply circuit. A first transistor is connected between the supply level and ground and having a gate connected to the output of the operational amplifier, where the first transistor is connected through a resistor to the first supply level and the gate of the output transistor is connected to a node between the resistor and the first transistor. A capacitance and a second transistor are connected in series between the output of the operational amplifier and the node between the resistor and the first transistor, where the gate of the second transistor is connected to receive a first voltage level. A bias circuit having first and second legs provides the first voltage level. The first leg has a current bias dependent upon the current at the output node of the voltage supply circuit. The second leg uses the bias level of the first leg and has one or more diode connected transistors connected in series though which the current of the second leg runs to ground, where the first voltage level is taken from a node of the second leg above the one or more diode connected transistors.

Various aspects, advantages, features and embodiments of the present invention are included in the following description of exemplary examples thereof, whose description should be taken in conjunction with the accompanying drawings. All patents, patent applications, articles, other publications, documents and things referenced herein are hereby incorporated herein by this reference in their entirety for all purposes. To the extent of any inconsistency or conflict in the definition or use of terms between any of the incorporated publications, documents or things and the present application, those of the present application shall prevail.

DETAILED DESCRIPTION

The following looks at techniques for improving the stability of op-amps used in memory products by using a transistor-based compensation scheme to cancel the right-half plane (RHP) zero. Also, a simple biasing scheme is proposed to reduce the variation of phase margin across process and temperature.

Considering some alternate approaches to this problem first, one approach is to use source-follower feedback to eliminate right-half plane (RHP) zero; although this can remove the feed-forward current, it limits the output voltage headroom. Another approach is using a current-buffer compensation to cancel the RHP zero, which, while removing the feed-forward current, does not track well with process and temperature variations. Yet another approach is to use a nulling resistor to cancel the RHP zero: although simple, this approach also does not track well with process and temperature variations. In another alternative, a transistor operated in the triode region is used as a nulling resistor, which is also simple and does track well with process and temperature variations.

Figure 1:
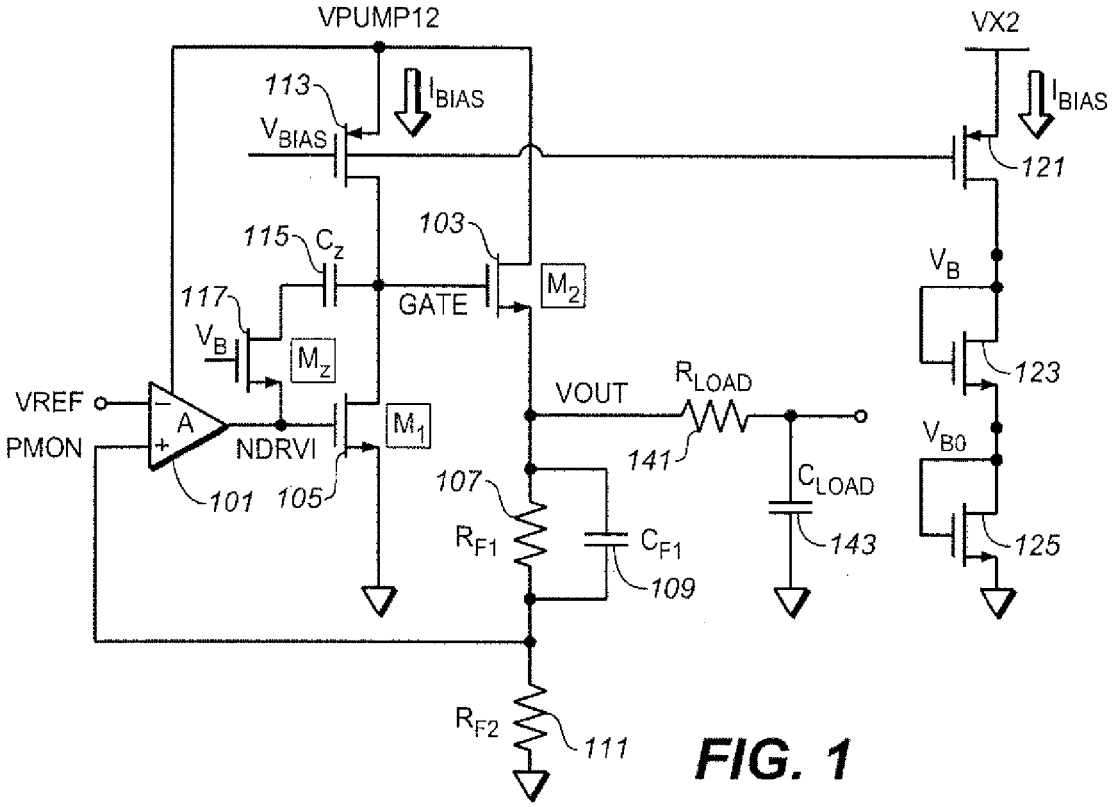
FIG. 1 is an example of an op-amp circuit using a transistor to cancel the RHP zero.

FIG. 1 looks at the last of these approaches, namely using a transistor to cancel the RHP zero, in more detail. In FIG. 1, an output node VOUT for the circuit is connected to a load represented by $R_{LOAD}$ 141 and $C_{LOAD}$ 143 and is supplied by the transistor $M_2$ 103. The transistor $M_2$ 103 is connected between a supply level of VPUMP12 and, through a divider, to ground. In applications such as on memory devices, as indicated by its labeling the supply level VPUMP12 can be a fairly high voltage, say 12V, as supplied from a charge pump. Here the divider is a resistor $R_{F1}$ 107 in parallel with a capacitor $C_{F1}$ 109 that are both in series with another resistor $R_{F2}$ 111, but other arrangements can be used. An op-amp A 101 has it inputs connected to receive a reference level VREF and feedback PMON from the output level, here taken from the node between $R_{F1}$ 107 and $R_{F2}$ 111, and provides an output NDRVI. NDRVI is connected to the control gate of transistor $M_1$ 105 that is connected between ground and, through a current source transistor 113, to the supply level. The current source transistor 113 is controlled by a level $V_{BIAS}$ to provide a current $I_{BIAS}$. The node GATE between $M_1$ 105 and current source transistor 113 is then connected to the gate of the supply transistor $M_2$ 103.

In FIG. 1, a transistor $M_Z$ 117 is introduce to cancel the RHP zero, where this is connected in series with the capacitance $C_Z$ 115 between the node GATE controlling the supply transistor $M_2$ 103 and the output NDRVI of the op-amp 101. The transistor $M_Z$ 103 operates in the triode region to provide an equivalent resistance. The $I_{BIAS}$ is generated from the current source transistor 113 is mirrored to the bias circuit to give a $V_B$ generation to bias $M_Z$ 103. The biasing circuitry for generating $V_B$ is formed of another current source transistor 121 connected in series with a pair of diode connected transistors 123 and 125 between a supply level VX2 and ground. The gate of 121 is connected to the same level as the gate of 113 and the level $V_B$ is then taken from a node between 121 and the upper diode 123, Although the circuit of FIG. 1 can provide cancellation for the right-half plane (RHP) zero, it has some shortcomings. An important one of these has to do with the applications, in which such circuits are used, specifically in applications such as in flash memory where the supply level VPUMP12 can be 10V or more, placing a large amount of stress across the current source transistor 113. Because of this, the device 113, and consequently the circuit as a whole, will not have level performance over time as the transistor will break down over time.

Figure 2:
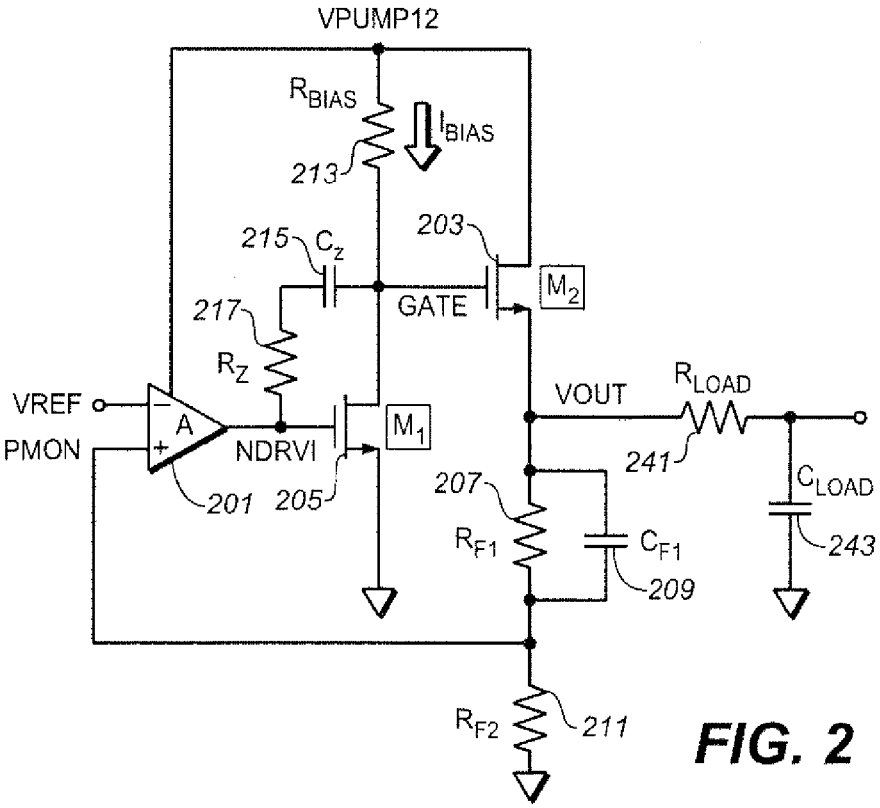
FIG. 2 is an example of an op-amp circuit using a resistor to cancel the RHP zero.

To get around this problem, an arrangement such as in FIG. 2 can be used. In FIG. 2, many of the elements are the same as in FIG. 1 and similarly numbered (i.e., $M_2$ is 103 in FIG. 1 and 203 in FIG. 2). To avoid the electronic design rule (EDR) concerns of FIG. 1, $I_{BIAS}$ is generated in FIG. 2 using a resistor $R_{BIAS}$ 213 instead of the transistor 113. Although $R_{BIAS}$ 213 can handle the higher supply voltages, this does not allow for $I_{BIAS}$ to mirrored as in FIG. 1 and be used to generate a control gate voltage for $M_Z$ 217. FIG. 2 instead uses $R_Z$ 217 to cancel the RHP zero; and although this provides for a reactively simple implementation that can take the high supply levels, it also has some undesirable features. One of these concerns phase margin variations. These occur due to feed-forward zero movement as $R_Z$ 217 and $g_{M1}$, the gain of $M_1$ 205, change due to process and temperature variations, so that different output levels change $g_{M1}$ and, hence, the zero location. To counteract this and ensure stability, the bandwidth of the amplifier may need to be reduced by design.

Figure 3:
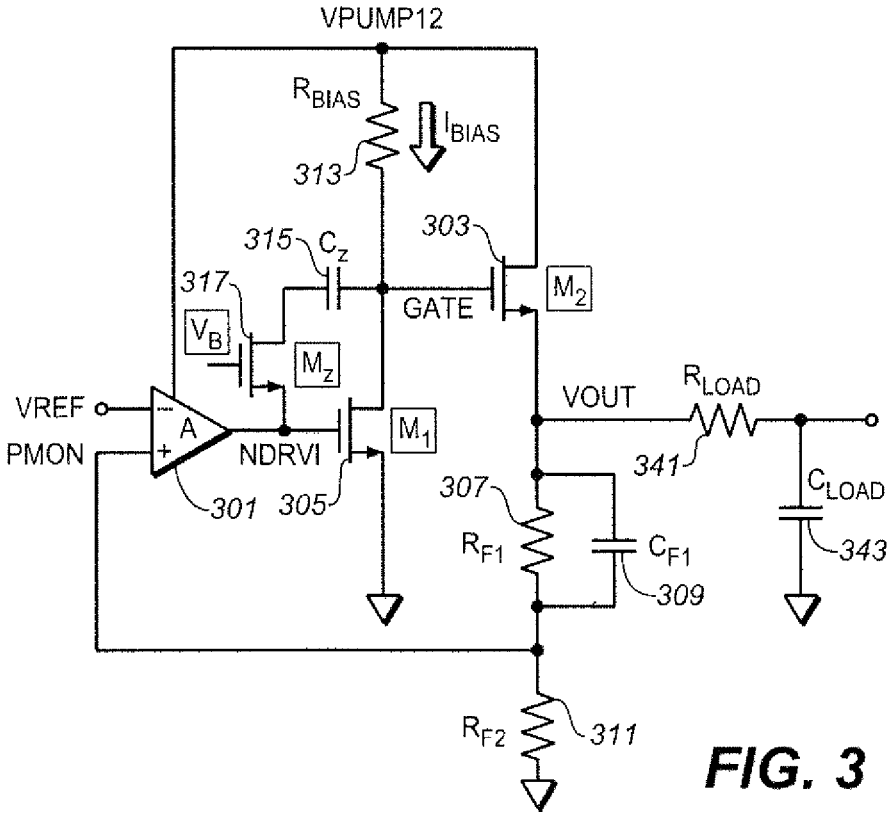
FIGS. 3 and 4 illustrate an exemplary embodiment of a regulator circuit providing improved stability of the op-amp.
Figure 4:
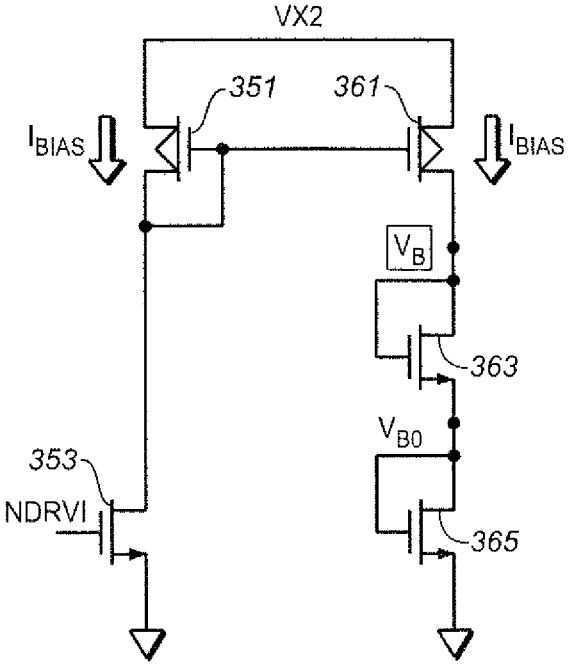

FIGS. 3 and 4 illustrate an exemplary embodiment for overcoming the sort of problems found in the circuits of FIGS. 1 and 2, where corresponding elements in FIG. 3 are again numbered similarly to those in FIGS. 1 and 2. As in FIG. 1, the resistance $R_Z$ is implemented by a transistor $M_Z$ 317. This has the advantages that $M_Z$ 317 tracks the process variations of $M_1$ 305 to achieve better stability, so that bandwidth reduction to ensure stability is not required. So that the circuit can also deal well with high supply voltage levels, FIG. 3 retains a resistor $R_{BIAS}$ 313 above $M_1$ 305. Although use of the $R_{BIAS}$ 313 above $M_1$ 305 solves the breakdown problems of the current source transistor 113 in FIG. 1, this means that another way is need to generate the gate voltage $V_B$ for $M_Z$ 317 as this previous current source is not available.

FIG. 4 is an exemplary embodiment for a circuit to generate $V_B$ using a local bias circuit. $I_{BIAS}$ is generated by using a mirroring arrangement to equal the voltage at the source node of $M_Z$ 317. On the left leg of FIG. 4, a diode connected PFET 351 is in series with the transistor 353 is connected between the supply level VX2 and ground. The gate of transistor 353 is connected to take the output NDRVI of the op-amp A 303, generating the current level $I_{BIAS}$. This current is then used to generate $I_{BIAS}$ in the right leg through the PFET 361 whose gate is connected to that of 351. The current then flows through the diode connected transistors 363 and 365 to ground. The level $V_{B0}$, above 365 will be ≈NDRVI, the output of the op-amp 303. A level-shift of $V_{TH}$ is achieved using the diode 363 is then used to generate $V_B$ for the gate of $M_Z$ 317.

The voltage supply level for the supply circuit of FIG. 3, VPUMP12, is a high voltage supply generated from a charge pump. As noted above, it can be 10V or more. In the exemplary embodiment, VPUMP12 is around 12V and is used to provide bias voltages during READ and PROGRAM operations. The bias circuit section of FIG. 4 uses a lower level, VX2. VX2 is generated from a pump and is around 4V and can be used as a power supply for many level shifters, which convert signals from low voltage (<4V) to high voltage domains (≥4V). Also, VX2 can be used to bias switches that provide EDR protection for low voltage circuit blocks.

Note that under the arrangement of FIGS. 3 and 4, the level $V_B$ on the right leg of FIG. 4 will depend on the output level NDRVI of the op-amp 303 being used in the right leg and, consequently, through the feedback level PMON on the output level $V_{OUT}$ of the circuit. Because of this arrangement, level on the gate of $M_Z$ 317 will track changes in the level of the load, here represented by $R_{LOAD}$ 341 and $C_{LOAD}$ 343, and variations in the feedback divider circuit providing PMON.

Consequently, the exemplary embodiment of FIGS. 3 and 4 can provide an improved compensation scheme to cancel the right-half plane (RHP) zero that can used over a wide range of supply levels. Although the additional elements increase power consumption slightly (a few tens of μW for a typical implementation), the described scheme reduces variations in phase margin across process and temperature corners (over a 50% reduction in the variation of phase margin relative to the embodiment of FIG. 2 for a typical implementation). As such, it has the advantages of improving the stability of the amplifiers and enhancing their overall performance and accuracy, as well as improving the overall bandwidth of operation without a trade-off requirement for stability.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application, to thereby enable others skilled in the art to best utilize the invention in various embodiments and with various modifications as are suited to the particular use contemplated. It is intended that the scope of the invention be defined by the claims appended hereto.

It is claimed:

1. A voltage supply circuit comprising:

an output transistor connected between a first supply level and an output node of the voltage supply circuit;

an operational amplifier having a first input connected to a reference level and a second input connected to receive feedback derived from the level on the output node of the voltage supply circuit;

a first transistor connected between the first supply level and ground and having a gate connected to the output of the operational amplifier;

a first resistor through which the first transistor is connected to the first supply level, wherein the gate of the output transistor is connected to a node between the first resistor and the first transistor;

a first capacitance and a second transistor connected in series between the output of the operational amplifier and the node between the first resistor and the first transistor, where the gate of the second transistor is connected to receive a first voltage level; and a bias circuit to provide the first voltage level, where the bias circuit includes:

a first leg having a current bias dependent upon the current at the output node of the voltage supply circuit;

a second leg that uses the bias level of the first leg, the second leg having one or more diode connected transistors connected in series though which the current of the second leg runs to ground, where the first voltage level is taken from a node of the second leg above the one or more diode connected transistors.

2. The voltage supply circuit of claim 1, wherein the first leg of bias circuit includes a third transistor through which the current of the first leg runs to ground, wherein the gate of the third transistor is connected to receive the output of the operational amplifier.

3. The voltage supply circuit of claim 1, wherein the number of diodes connected transistors connected in series is two.

4. The voltage supply circuit of claim 1, wherein the first leg of bias circuit is connected to a second supply level through a diode connected PMOS transistor and the second leg of bias circuit is connected to the second supply level through a PMOS transistor whose gate is connected to the gate of the PMOS transistor of the first leg.

5. The voltage supply circuit of claim 4, wherein the second supply level is of a lower voltage than the first supply level

6. The voltage supply circuit of claim 1, wherein the output node of the voltage supply circuit is connected to ground through a voltage divider circuit, and wherein the second input of the operational amplifier receives feedback from a node of the voltage divider circuit.

7. The voltage supply circuit of claim 6, wherein the voltage divider circuit includes a second and a third resistance connected in series between the output node of the voltage supply circuit and ground, wherein said node of the voltage divider is between the second and third resistors.

8. The voltage supply circuit of claim 1, wherein the first supply level is greater than 10V.

* * * * *